US006034309A

United States Patent [19]

Teel et al.

[11] Patent Number: 6,034,309

[45] Date of Patent: Mar. 7, 2000

[54] METHOD OF MANUFACTURING A STRINGED INSTRUMENT

[75] Inventors: Timothy A. Teel, Lehighton; Frank Finocchio, Easton, both of Pa.

[73] Assignee: C.F. Martin & Company, Inc., Nazareth, Pa.

[21] Appl. No.: 09/321,341

[22] Filed: May 28, 1999

[51] Int. Cl.[7] ..... G10D 3/00

[52] U.S. Cl. ..... 84/291; 84/267; 84/290

[58] Field of Search ..... 84/291, 267, 290

[56] References Cited

U.S. PATENT DOCUMENTS

| | | | |
|---|---|---|---|
| 3,424,048 | 1/1969 | Mark et al. | 84/290 |
| 3,474,697 | 10/1969 | Kaman | 84/267 |
| 3,656,395 | 4/1972 | Kaman | 84/267 |
| 3,685,385 | 8/1972 | Rendell | 84/267 |
| 3,892,159 | 7/1975 | Houtsma | 84/307 |
| 3,974,730 | 8/1976 | Adams, Jr. | 84/291 |
| 4,079,654 | 3/1978 | Kasha | 84/291 |
| 4,084,475 | 4/1978 | Horowitz | 84/291 |
| 4,178,827 | 12/1979 | Mallory | 84/291 |
| 5,406,874 | 4/1995 | Witchel | 84/291 |
| 5,461,958 | 10/1995 | Dresdner et al. | 84/267 |

OTHER PUBLICATIONS

Currently pending U.S. Patent Application 09/111,102 filed on Jul. 6, 1998 invented by Timothy A. Teel and assigned to C.F. Martin & Company, Inc.

"C.F. Martin & Co. Unveils Innovative & Economical 'DXM' Dreadnought", The Sounding Board, The Official Newsletter of the Martin Guitar Company, vol. 5, Jul. 1998, p. 4.

*Primary Examiner*—Robert E. Nappi
*Assistant Examiner*—Shih-Yung Hsieh
*Attorney, Agent, or Firm*—Howson & Howson

[57] ABSTRACT

A method of manufacturing an acoustic guitar having a pre-finished resin laminate soundboard, sidewall and backboard. The contoured sidewall of the guitar is provided by a relatively flexible strip of the laminate material which is formed into a loop-shaped preform before being positioned within a multi-part fixture. The fixture is closed on the preform to conform the shape of the preform into a contoured shape. Subsequently, ribbon linings, a soundboard and a backboard are adhesively secured to the preform to complete the assembly of the hollow body portion of the acoustic guitar. Since he laminate material is pre-finished, numerous time consuming finishing steps typically preformed in known methods are eliminated.

20 Claims, 3 Drawing Sheets

10
12
14
16
18
20
22
24

"h"
38
40
28

32
30
30b
34
36

56
42
28
58
30b
26
32
30

42a
36
38
30a
34

METHOD OF MANUFACTURING A STRINGED INSTRUMENT

FIELD OF THE INVENTION

The present invention relates to manufacturing stringed instruments, such as, acoustic guitars, and more particularly, the present invention relates to a method of manufacturing hollow acoustic guitar bodies from sheets of wood-fiber derivative material laminated under high pressure.

BACKGROUND OF THE INVENTION

A typical acoustic guitar has a hollow body connected to a neck. The hollow body has a soundboard with a soundhole, a backboard spaced from the soundboard, and a shaped sidewall which connects between the soundboard and backboard. Typically, these components are constructed of choice pieces of wood in order to produce instruments of superior quality.

The typical manufacturing process of the hollow body portion of a wooden acoustic guitar, includes the preparation of a sidewall from two separate, identical elongate piece of wood. The elongate pieces of wood are subjected to heat treatment and are reshaped so that they provide a particular contour when the two sidewall pieces are mated and secured together with wood glue in an opposed relation. A frontblock, a rearblock, a pair of ribbon linings, a soundboard and a backboard are each attached to the sidewall with wood glue and clamped to the sidewall until the glue is permitted to set. The exterior surface of the wooden hollow guitar body is then subjected to numerous finishing steps to protect the wood and provide it with a wanted appearance. The neck and strings are attached to complete the manufacturing process of the acoustic guitar.

Recently, acoustic guitar bodies have been manufactured from high pressure laminate materials. For example, U.S. Pat. No. 5,406,874 issued to Witchel discloses an acoustic guitar constructed from relatively inexpensive, non-wooden materials. The hollow body of the guitar, including the sidewall, soundboard and baseboard, is constructed of sheets of synthetic resin laminates, such as, melamine impregnated resins impressed over phenolic kraft layers.

Pending U.S. patent application Ser. No. 09/111,102 filed on Jul. 6, 1998 by the assignee of the present application provides another example of a guitar body made of high pressure laminate materials. The guitars made of non-wooden laminates provide an economic alternative for the purchaser of a high quality acoustic guitar, and due to dwindling wood resources, provide an ecologically-friendly alternative to traditional solid and laminated tonewoods.

Although ecologically-friendly guitars assemblies are known, there is a need for an efficient process of manufacturing high quality, durable acoustic guitars from inexpensive high pressure laminated materials. In particular, the construction of a hollow instrument body having a high quality, durable finish should be capable of being efficiently and economically accomplished utilizing a minimum of steps. The efficient manufacturing process should further enhance the economic advantage of such ecologically-friendly musical instruments.

OBJECTS OF THE INVENTION

With the foregoing in mind, a primary object of the present invention is to provide a method of manufacturing a high-quality acoustic guitar which provides an economic alternative relative to traditional acoustic guitar models manufactured from tonewoods.

Another object of the present invention is to provide a novel and efficient method of manufacturing an acoustic guitar hollow body portion with a sidewall which is constructed of a relatively inexpensive, non-wooden material and which has an exterior surface with a durable, high-quality finish.

A further object of the present invention is to provide a unique and relatively quick manner of forming a contoured guitar body sidewall and of assembling the various guitar body components to the sidewall.

SUMMARY OF THE INVENTION

More specifically, the present invention provides an efficient method of manufacturing t stringed instrument body of a desired configuration. A multi-part fixture is provided having opposed inner surfaces moveable between an open position for receiving a flexible laminate preform and a closed position for shaping the laminate preform into an instrument body configuration. An elongate strip of the laminate, which has longitudinal edges and opposite transverse ends, is positioned into a closed continuous preform body of amorphous flexible shape. The preform is disposed in the open fixture, and the fixture is closed thereon to deform the flexible preform into the instrument body configuration. Front and rear panels are secured to the shaped preform to form the instrument body.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
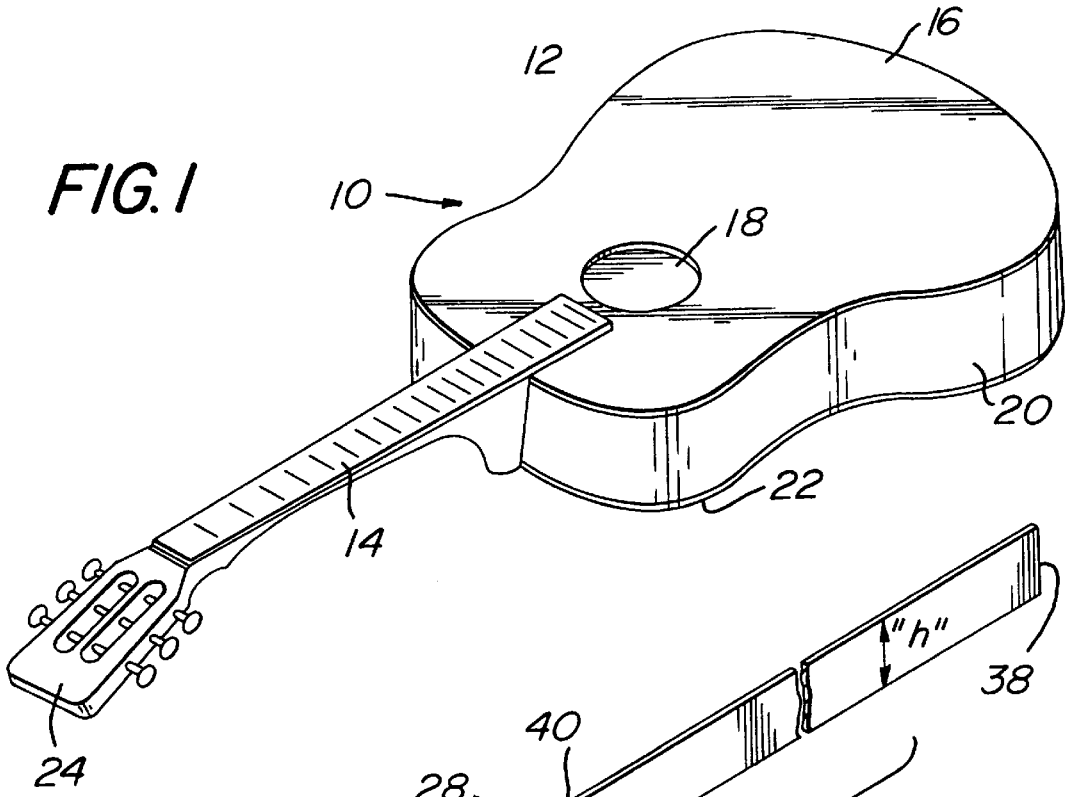
FIG. 1 is a perspective view of an acoustic guitar according to the present invention.

Referring now to the drawings, FIG. 1 illustrates an acoustic guitar 10 having a hollow body 12 and a neck 14. The body has a soundboard 16 with a circular soundhole 18. The soundboard 16 is connected to sidewall 20 which, in turn, is connected to a backboard 22. The neck 14 has a headstock 24, and strings (not shown) are strung from the headstock 24 in a direction along the neck 14, across the soundhole 18 and to a bridge (not shown) on the soundboard 16. The hollow body 12 includes a frontblock 26 to which the neck 14 is connected and a rearblock 28 opposite the frontblock 26.

An important aspect of the present invention is that the soundboard 16, backboard 22 and sidewall 20 are constructed of sheets of synthetic resin laminates, preferably, melamine impregnated resins impressed over phenolic kraft layers, so that the acoustic guitar 10 is capable of being manufactured economically in relative comparison to acoustic guitars manufactured completely of wooden materials.

The previously discussed prior art, U.S. Pat. No. 5,406,874 issued to Witchel and pending U.S. patent application Ser. No. 09/111,102, each disclose an acoustic guitar having a soundboard manufactured from sheets of melamine. The disclosures provided by U.S. Pat. No. 5,406,874 and pending U.S. patent application Ser. No. 09/111,102 are incorporated herein by reference.

Figure 2:
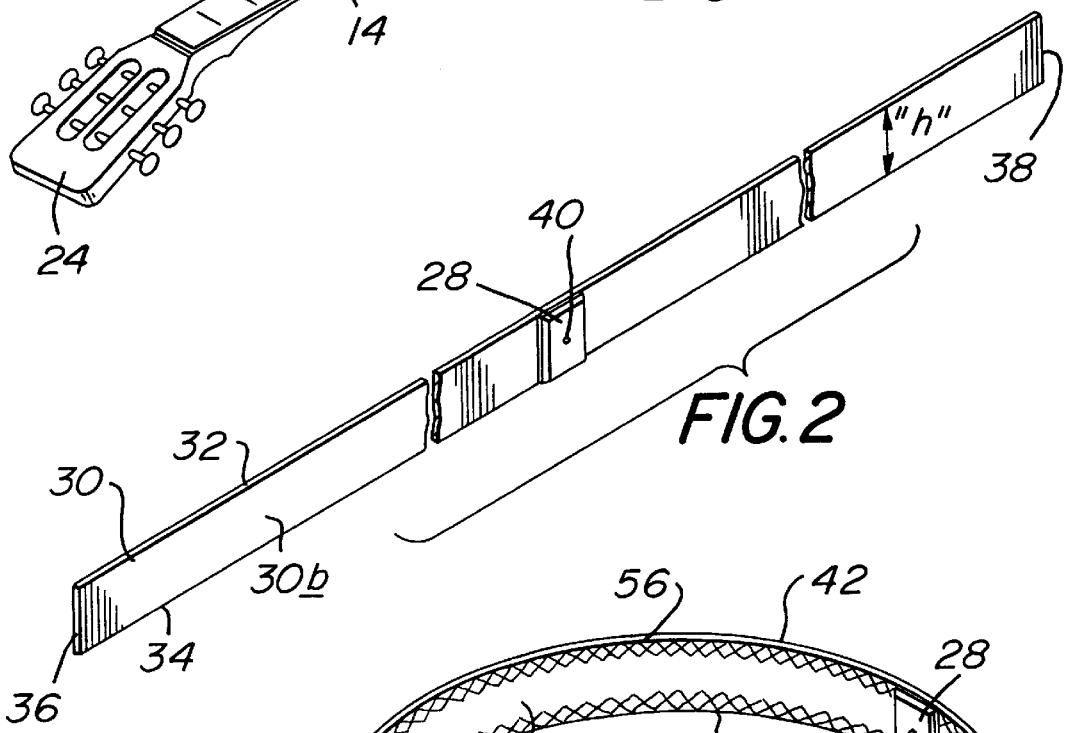
FIG. 2 is a perspective view of a flexible elongate strip of laminate material used to make the contoured sidewall of the acoustic guitar illustrated in FIG. 1.

According to the method of the present invention and as illustrated in FIG. 2, an elongate strip 30 of a flexible laminate material, such as a synthetic resin laminate, is utilized to form the contoured sidewall 20. To this end, the strip 30 has opposite longitudinal edges, 32 and 34, and opposite transverse ends, 36 and 38. Although not illustrated in th( drawings, the height "h" of the strip 30 can vary along its length so that the backboard 22, when attached to the sidewall 20, arches to better reflect sound toward the soundhole 18. In addition, the strip 30 is provided with a precisely cut length between the ends 36 and 38, and has a pre-finished outward facing wall 30*a* which, after assembly, requires no finishing steps to seal and protect the wall 30*a*. The elimination of the finishing steps greatly reduces the amount of time, labor and cost required to complete the manufacturing process of an acoustic guitar 10.

Before the elongate strip 30 is formed into a loop-shaped preform 42, a rearblock 28 is adhesively secured to the inward facing wall 30*b* of the elongate strip 30 with, for instance, an aliphatic resin. Preferably, the rearblock 28 is secured at a centered location which is equidistant from the opposite ends 36 and 38. See FIG. 2.

Figure 3:
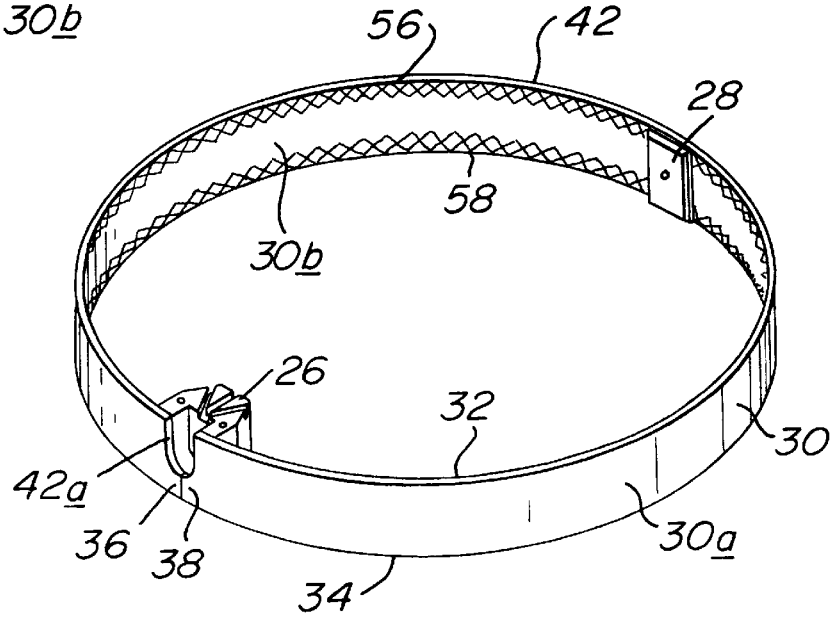
FIG. 3 is a perspective view of the elongate strip of FIG. 2 formed into a flexible loop-shaped preform.

As illustrated in FIG. 3, the flexible strip 30 is readily formed into a loop-shaped preform 42 and the opposite ends, 36 and 38, are adhesively secured with, for instance, an aliphatic resin, in abutting relation to the frontblock 26. Preferably, the frontblock 26 extends inwardly from the inward facing wall 30*b* of the strip 30.

After the preform 42 is formed, various drilling, routing and adhesive applying steps are performed on the preform. A hole 40 is drilled through the rearblock 28 and preform 42, and holes (not shown) are drilled into the frontblock 26 and preform 42. A portion 42*a* of the preform 42 adjacent the frontblock 26 is cut away with a router. A contact adhesive is applied with a handheld rolling device along the inner peripheral upper and lower longitudinal edges, 32 and 34. The locations 56 and 58 of the applied contact adhesive is illustrated by cross-hatching in FIG. 3.

Figure 4:
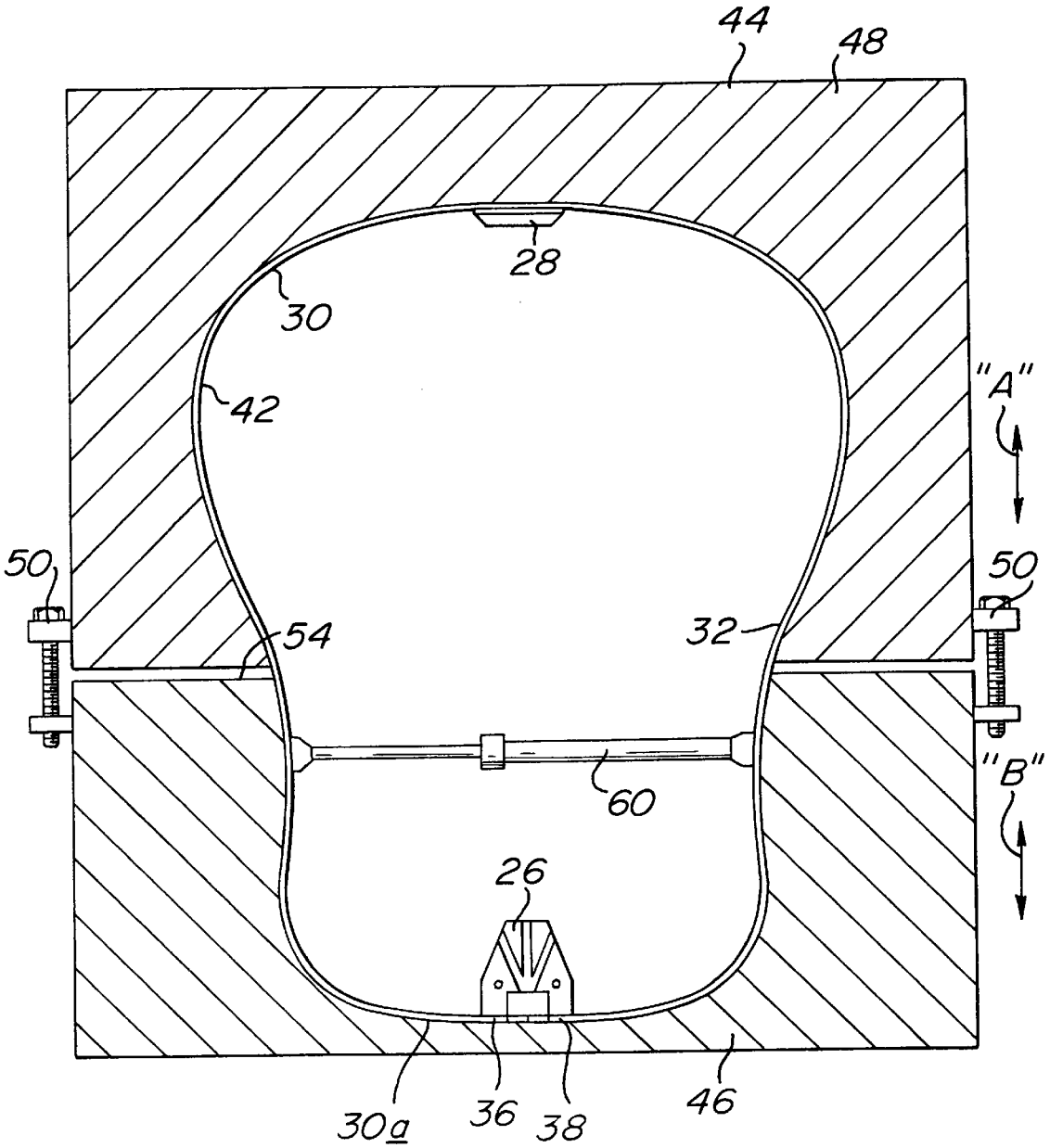
FIG. 4 is a plan view of the preform of FIG. 3 located within a multi-part fixture which is closed thereon.
Figure 5:
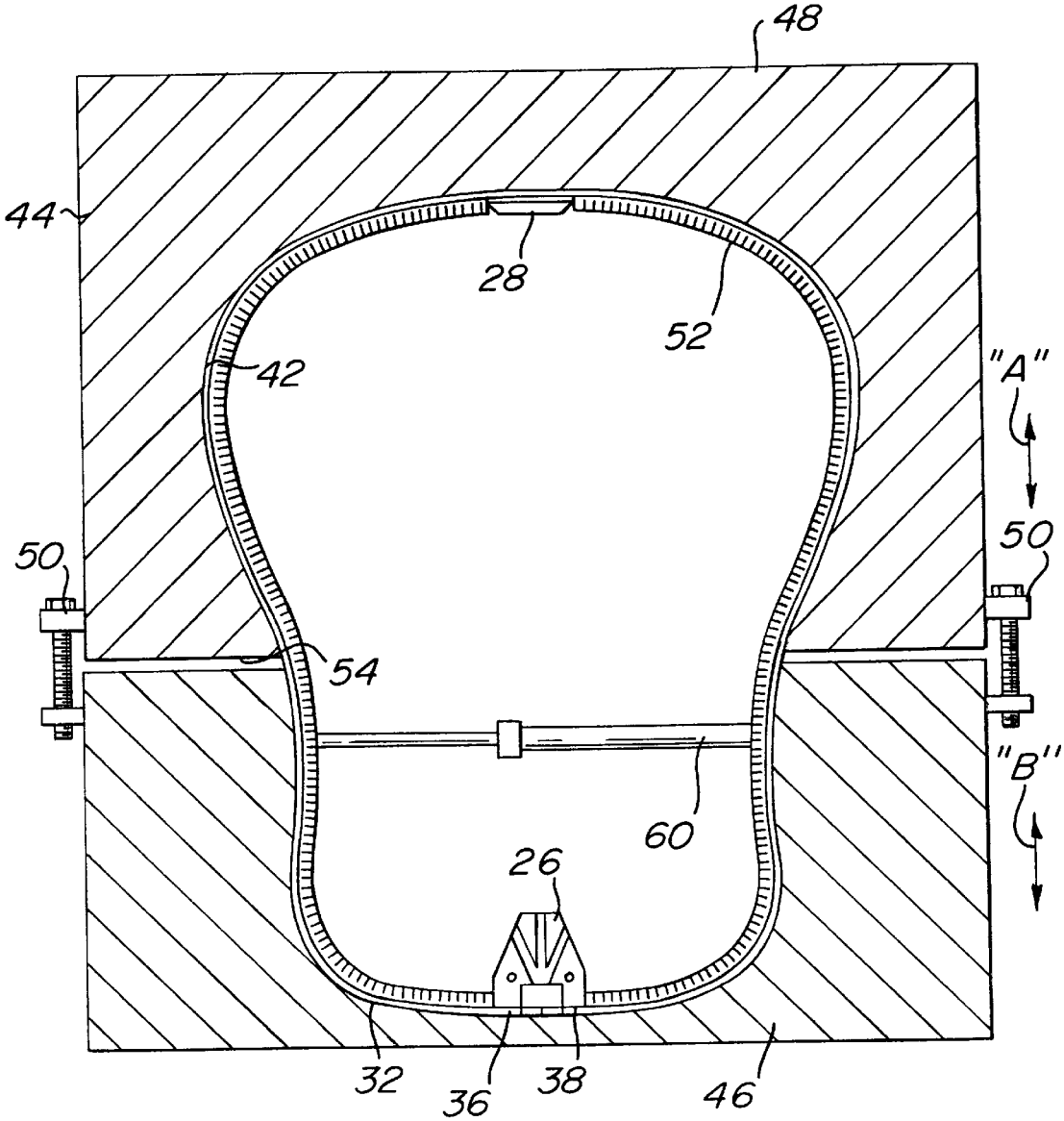
FIG. 5 is a plan view of the preform of FIG. 4 after a ribbon lining has been added to the longitudinal edges of the preform.

A multi-part fixture 44 is utilized to shape the preform 42 into the contoured sidewall 20 having a waist. As illustrated in FIGS. 4 and 5, preferably the fixture 44 includes an upper body section 46 and a lower body section 48 which can be positioned in open and closed positions as indicated by the arrows "A"and "B". The loop-shaped preform 42 is located between fixture sections 46 and 48 when the fixture sections are disposed in an open position (not shown). Subsequently, the fixture sections 46 and 48 are closed about the preform 42, as shown in FIGS. 4 and 5, and conform the flexible preform 42 into a contoured sidewall shape. Preferably, after the fixture 44 is closed on the preform 42, an expandable spreader bar, or cross arm, 60 is installed within the preform to ensure that the inward extending waist portions of the preform 42 are urged against the walls of the fixture 44. The spreader bar 60 is properly positioned to contact the preform 42 without contacting the exposed contact adhesive locations 56 and 58. In addition, the fixture 44 can engage the holes previously drilled into the frontblock 26 and rearblock 28 to ensure proper alignment of the preform 42 within the fixture 44.

In the illustrated embodiment, the upper body section 46 of the fixture 44 engages the portion of the preform 42 including the ends 36 and 38 of the strip 30 and the frontblock 26; while, the lower body section 48 engages the opposite portion of the preform 42. A parting line 54 is formed between sections 46 and 48 and extends in a direction transverse to the lengthwise direction of the guitar strings which are eventually installed on the assembled guitar. The fixture sections 46 and 48 are locked and closed by a locking mechanism 50 of any known type.

The fixture 44 is portable and permits ready access to both longitudinal edges 32 and 34 of the preform 42. Thus, as illustrated in FIG. 5, while the preform 42 is held within the fixture 44, a ribbon lining 52 is attached to the preform 42 adjacent the longitudinal edge 32. To this end, the ribbon lining 52 is positioned and pressed into engagement wit the contact adhesive at location 56 previously applied before the preform 42 was located in the fixture 44. A pressure applying roller device (not shown) is utilized to apply pressure to the ribbon lining 52 and preform 42 to ensure proper securement. The applied pressure should be sufficient to secure the ribbon lining 52 to the preform 42 without cracking the preform 42. If desired, the preform 42 can be heated before it is positioned within the fixture 44 to eliminate the possibility of preform cracking. After the first ribbon lining 52 is attached, the fixture 44 is flipped over so that a second ribbon lining (not shown) can be pressed to the contact adhesive located adjacent the opposite longitudinal edge 34.

The contact adhesive is quick drying when exerted with a pressure. Thus, after a short period of time after the ribbon linings are installed, the spreader bar 60 is removed from the preform 42 and the preform 42 is removed from the fixture 44. After removal, the preform 42 is substantially rigid and retains the wanted contoured sidewall shape due to the ribbon lining connections. Both longitudinal edges 32 and 34 of the sidewall-shaped preform 42 are sanded and appropriate portions of the ribbon linings are shaved in order to mate with end sections of the bracing (not shown) located of the undersides of the soundboard 16 and backboard 22. The soundboard 16 and backboard 22 are then adhesively secured to the longitudinal edges 32 and 34, respectively, of the sidewall-shaped preform 42. Preferably, the assembly is then located within a press (not shown) for about one hour.

The assembled hollow body 12 is removed from the press, and as stated previously, since the sidewall, soundboard and backboard are pre-finished, no subsequent finishing steps are required. The neck 14 having a headstock 24 is connected to the assembled hollow body 12 and strings (not shown) and a bridge (not shown) are added. The neck 14 and headstock 24 are preferably made of conventional wooden materials.

The method of the present invention provides for quick assembly of the hollow body 12 and the guitar 10. The method utilizes the flexibility of the laminate material to readily form the required sidewall contour without heat treatments. The pre-finished nature of the laminate material eliminates numerous finishing steps typically required when utilizing a wooden sidewall, soundboard and backboard.

Various modifications to the guitar, method or fixture are contemplated. For example, the shape of the sidewall, the specific material of the laminate, and the configuration of the fixture can be modified. The fixture can be provided in more, or less, than two parts; the parting line between the fixture sections could extend differently then illustrated; and the release mechanism of the fixture could be provided by a quick release latch. In addition, the fixture sections could be hinged along one confronting edge such that they are pivoted into open and closed positions.

While a preferred embodiment of an acoustic guitar has been described, various modifications, alterations, and changes may be made without departing from the spirit and scope of the present invention as defined in the appended claims.

We claim:

1. A method of manufacturing a stringed instrument body of a desired configuration comprising the steps of:

providing a fixture having opposed inner surfaces for receiving a flexible laminate preform and for shaping said laminate preform into an instrument body configuration;

forming an elongate strip of said laminate, having longitudinal edges and opposite transverse ends, into a closed continuous preform body of amorphous flexible shape;

disposing said amorphous body preform into said fixture to deform said preform into said instrument body configuration; and fastening front and rear panels to said body configuration to form the instrument body.

2. The method according to claim 1, further comprising the step of fastening said laminate ends in abutting relation to a block.

3. The method according to claim 2, wherein said fastening of said laminate ends is accomplished before said step of disposing said body preform into said fixture.

4. The method according to claim 2, wherein said fixture is multi-part and includes an upper body section and a lower body section, and wherein said body preform is positioned in said fixture with said abutting ends disposed in said upper section.

5. The method according to claim 1, wherein said fixture is portable and permits access to both of said opposed longitudinal edges of said laminate.

6. The method according to claim 1, wherein said laminate is a high pressure phenolic substrate.

7. The method according to claim 1, wherein said laminate strip is prefinished before being placed in said fixture.

8. The method according to claim 1, further comprising the step of fastening a pre-finished neck to said formed instrument body.

9. A method of manufacturing an acoustic guitar body having a sidewall with a contoured waist, comprising the steps of:

providing a flexible pre-finished elongate strip of a laminate material, said strip having longitudinal edges and transverse ends;

fastening said ends of said strip in an abutting relation to form a loop-shaped preform having a pair of peripheral edges;

providing a multi-part fixture having opposed inner surfaces moveable between an open position and a closed position; and disposing said preform into said fixture when said fixture is in said open position, and closing said fixture on said preform to manipulate said loop-shape of said preform into a contoured-shaped sidewall of the acoustic guitar body.

10. The method according to claim 9, further comprising the step of fastening at least one inner peripheral ribbon lining adjacent at least one of said peripheral edges of said preform when said preform is located in said fixture in said closed position.

11. The method according to claim 10, further comprising the step of applying a contact adhesive to said preform before locating said preform in said fixture, said contact adhesive being utilized to fasten said ribbon lining to said preform.

12. The method according to claim 10, further comprising the step of attaching a rearblock to a mid-portion of said elongate strip before fastening said ends together.

13. The method according to claim 12, wherein said ends are fastened together by securing said ends to a frontblock.

14. The method according to claim 13, further comprising the step of drilling at least one hole in at least one of said rearblock and frontblock after said loop-shaped preform is formed but before said fixture is closed on said preform.

15. The method according to claim 10, further comprising the steps of attaching a soundboard to one of said peripheral edges of said preform after said ribbon lining attachment step and after said preform is removed from said fixture; and attaching a backboard to the opposite one of said longitudinal edges of said preform after said ribbon lining attachment step and after said preform is removed from said fixture.

16. The method according to claim 15, further comprising the step of attaching a guitar neck to the acoustic guitar body after said soundboard and backboard have been attached to said preform.

17. The method according to claim 9, wherein said laminate material is a synthetic resin laminate.

18. A method of manufacturing an acoustic guitar body having a contoured sidewall, comprising the steps of:

providing a flexible pre-finished elongate strip of a laminate material, said strip having longitudinal edges and transverse ends;

securing said ends of said strip in an abutting relation to a frontblock to form a loop-shaped preform having a pair of opposite peripheral edges;

providing a multi-part fixture having opposed inner surfaces moveable between an open position and a closed position;

disposing said preform into said fixture when said fixture is in said open position, and closing said fixture on said preform to manipulate said loop-shape of said preform into a contoured-shape of the sidewall of the acoustic guitar body;

securing an inner peripheral ribbon lining with a contact adhesive adjacent each of said peripheral edges of said preform when said preform is located in said closed fixture;

removing, said preform from said fixture after said ribbon lining securement step, and then, securing a soundboard to one of said peripheral edges of said preform and securing a backboard to the opposite one of said longitudinal edges of said preform;

whereby, after said soundboard and backboard are secured to said preform, a finished hollow guitar body is provided to which a guitar neck can be secured to complete the assembly.

19. The method according to claim 18, wherein said contact adhesive is applied to said loop-shaped preform before said preform is located in said fixture.

20. An acoustic guitar body manufactured by the method of claim 19.

* * * * *